US006923478B2

(12) United States Patent
Geurden

(10) Patent No.: US 6,923,478 B2
(45) Date of Patent: Aug. 2, 2005

(54) LOCK WITH ROTARY LATCHES, ESPECIALLY FOR MOTOR VEHICLES

(75) Inventor: Armin Geurden, Grefrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/609,197

(22) Filed: Jun. 28, 2003

(65) Prior Publication Data

US 2004/0026931 A1 Feb. 12, 2004

(30) Foreign Application Priority Data

Jul. 10, 2002 (DE) ..... 202 10 658 U

(51) Int. Cl.[7] ..... E05C 9/10

(52) U.S. Cl. ..... 292/28; 292/11; 292/25; 292/45; 292/56

(58) Field of Search ..... 292/11, 24–29, 292/56, 110, 116–120, 213, 44–50; 464/78, 179, 181; 267/181

(56) References Cited

U.S. PATENT DOCUMENTS 2,238,480 A * 4/1941 Tierney ..... 292/28
3,128,120 A * 4/1964 Fournier et al. ..... 296/57.1
3,134,618 A * 5/1964 Heimann ..... 292/240
3,144,956 A * 8/1964 Anderson ..... 292/25
3,989,289 A * 11/1976 Ringe ..... 292/241
4,043,546 A * 8/1977 Ashfield et al. ..... 267/162
4,115,020 A * 9/1978 Langsford ..... 292/49
4,170,376 A * 10/1979 Banerjea ..... 292/218
4,449,955 A * 5/1984 Watanabe et al. ..... 464/78
4,858,897 A * 8/1989 Irifune ..... 267/181
5,168,914 A * 12/1992 Keller ..... 292/48
5,232,073 A * 8/1993 Bronowicki et al. ..... 267/136
5,391,360 A * 2/1995 Kochte et al. ..... 292/11
6,203,437 B1 * 3/2001 Durie et al. ..... 464/78

FOREIGN PATENT DOCUMENTS

EP 568514 A2 * 11/1993 ..... F16D/3/72

* cited by examiner

*Primary Examiner*—Daniel P. Stodola
*Assistant Examiner*—Christopher Boswell
(74) *Attorney, Agent, or Firm*—Friedrich Kueffner

(57) ABSTRACT

A lock, especially for motor vehicles, for securing a movable part, such as a pivoting flap, in position with respect to a stationary part, such as a housing, includes two rotary latches at a certain distance apart, wherein two closing pieces engage in the rotary latches when the latches are in the closed position. The locking elements are connected to a shaft and are rotatable synchronously with the shaft. At least certain sections of the shaft have torsional rigidity in the rotational direction, but flexibility in the axial direction.

12 Claims, 3 Drawing Sheets

LOCK WITH ROTARY LATCHES, ESPECIALLY FOR MOTOR VEHICLES

BACKGROUND OF THE INVENTION

1. Field of the Invention

The invention pertains to a lock, especially for motor vehicles, for securing a movable part, such as a pivoting flap, in position with respect to a stationary part, such as a housing. The lock includes two rotary latches arranged at a certain distance apart, in which two closing pieces engage when the latches are in the closed position. Two locking elements hold the two rotary latches in their closed position and are designed as integral parts of the shaft connecting them to each other, so that the locking elements are able to rotate synchronously with the shaft. In their closed position, the two rotary latches cooperate with two closing pieces. The latches are secured in their closed position by two locking elements, which are designed as integral parts of the shaft which connects them to each other. These elements are thus able to rotate synchronously with the shaft.

2. Description of the Related Art

In a known lock of this type, the two locking levers are designed as integral parts of the die-cast zinc shaft which synchronizes them. As a result of manufacturing processes and later as a result of fluctuations in temperature during use, angle tolerances and distortions develop, which can make it difficult to operate the lock as intended. These factors can also lead to twisting after the shaft has been installed, which can cause jamming.

SUMMARY OF THE INVENTION

The invention is based on the task of developing a lock of the type indicated above, which is characterized by a high degree of operating reliability.

This is achieved according to the invention by providing at least certain sections of the shaft with torsional rigidity in the rotational direction, but with flexibility in the axial direction.

The flexibility of the shaft or of at least one section of it provides compensation for tolerances, which can increase significantly under certain conditions during later use, depending on the amount of heat to which the shaft has been subjected. The synchronization of the two locking levers is nevertheless still ensured as a result of the good torsional rigidity of the shaft according to the invention. The one-piece design according to the invention of the shaft and the two locking levers represents a "combination" which allows the use of plastic. This has a favorable effect on the weight and on the price of the lock. The flexibility of the shaft, furthermore, is highly advantageous with respect to installation of the one-piece combination according to the invention in its bearings.

With respect to the shaft, this special combination according to the invention can be achieved by an alternating sequence of rigid and flexible axial sections. One possibility of realizing this is to make these two types of axial sections out of two different materials, namely, a material which bends easily and a material of greater strength. Both materials consist of plastic, and the combination of the two is created during the injection-molding process.

It has been found, however, that another possibility is especially advantageous, which consists in using the same material to make both of the two different axial sections of the shaft and in providing the two different axial sections with different profiles. Ways in which this idea can be realized in detail can be derived from the subclaims, from the following description, and from the drawings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

The lock according to the invention includes two rotary latches 11, 12, which are supported on two bearing blocks 31, 32 at points 13, 14. The bearing blocks 31, 32 are integral parts of a carrier 30. Because the two rotary latches are identical in design, it is sufficient to explain their design and function in greater detail on the basis of the rotary latch according to FIGS. 4 and 5.

Figure 1:
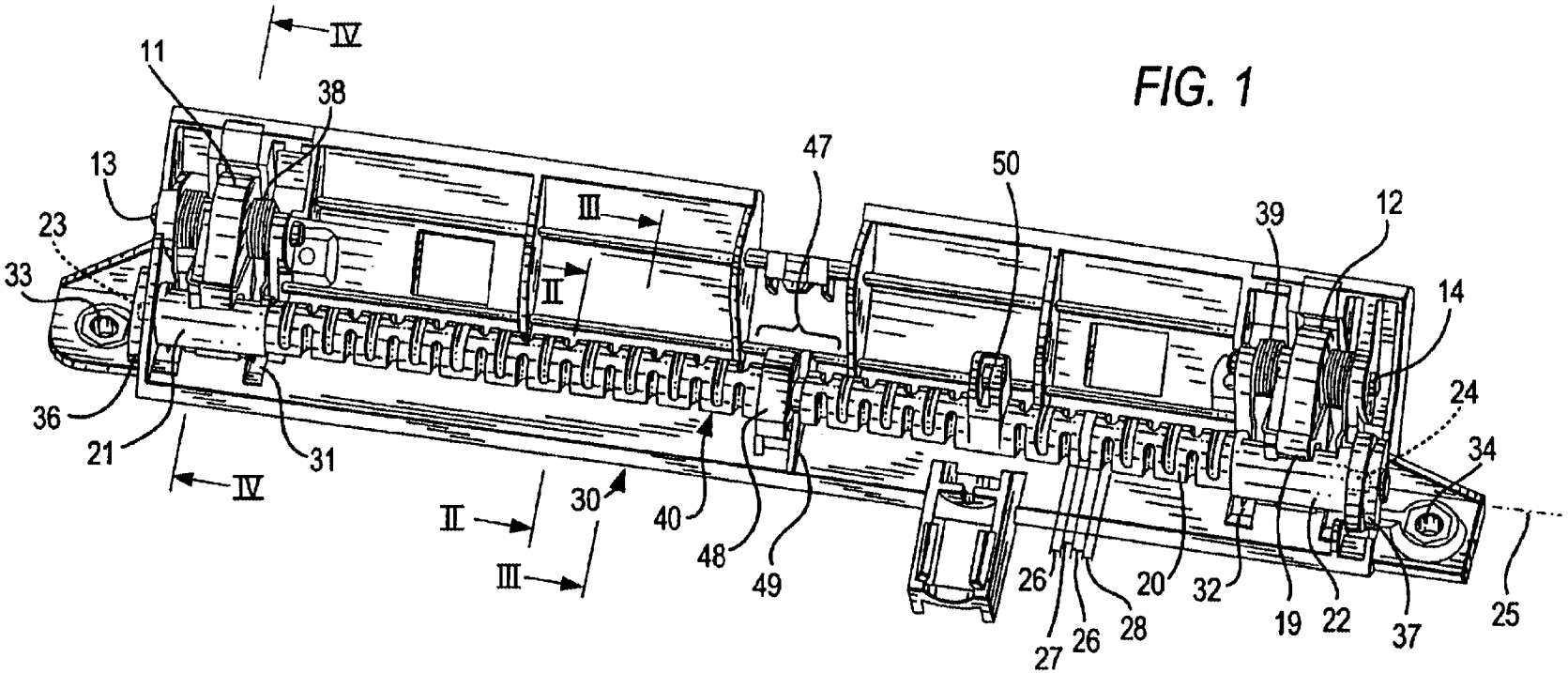
FIG. 1 shows a perspective view of a structural unit with the lock according to the invention, which is to be attached to a stationary part next to a pivoting flap.
Figure 4:
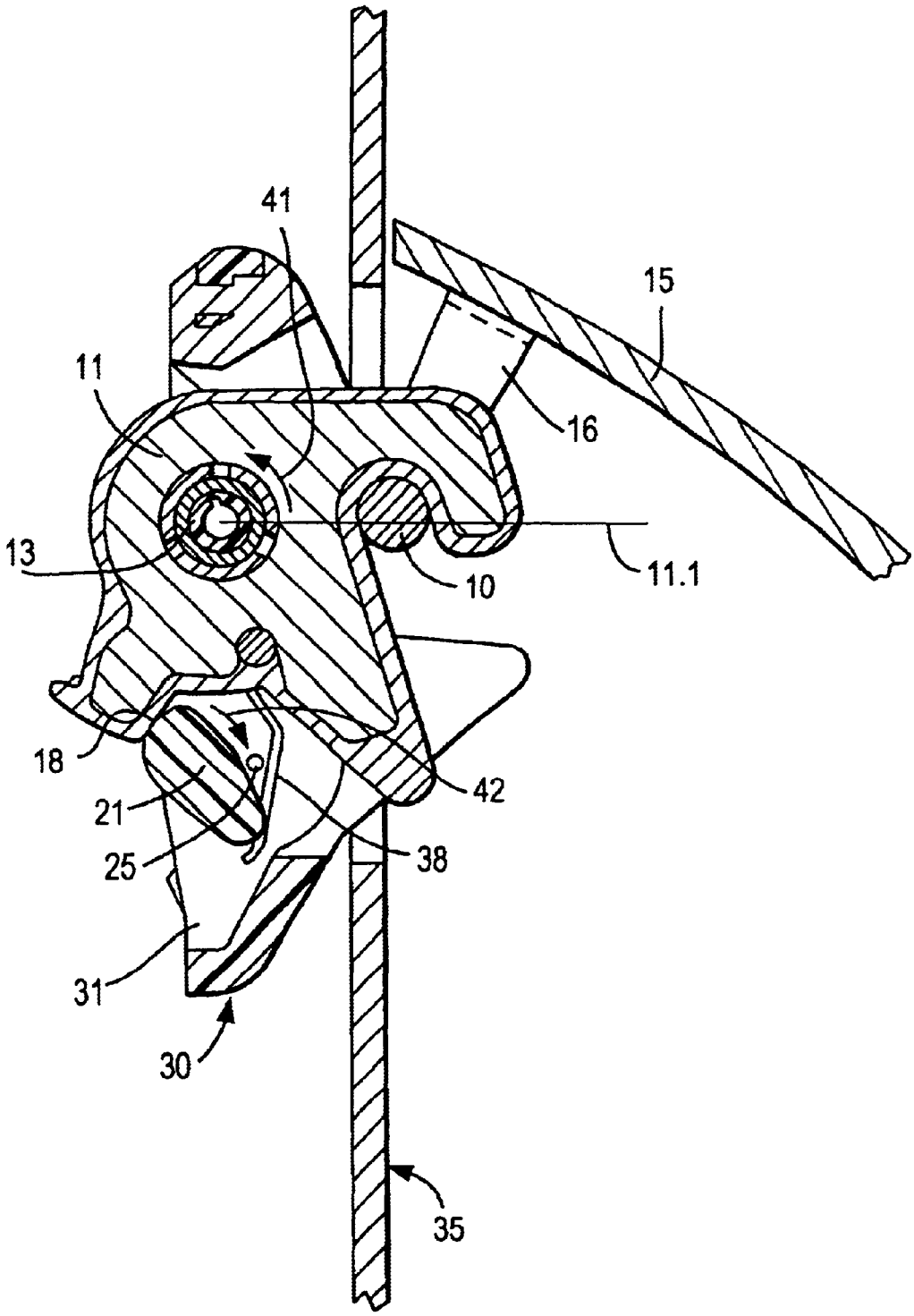
FIG. 4 shows an enlarged cross section through the structural unit of FIG. 1 along the line IV—IV in that figure, after the structural unit has been attached to the stationary part and is cooperating with a closing piece attached to a flap, where the flap is in its closed position with respect to the stationary part.

As illustrated in FIG. 4, the lock serves to hold a movable part 15, which consists in the present case of a pivoting flap, on a resting part 35. For this purpose, the carrier 30 supporting the two rotary latches 11, 12 is attached in the present case to the resting part 35, for which the attachment points 33, 34, which can be seen at the ends of the carrier in FIG. 1, are used. Two straps, which carry closing pieces 10, are attached to the pivoting flap 15, one being assigned to each of the two rotary latches 11, 12. Only one of the straps 16 with its closing piece 10 is shown in FIGS. 4 and 5.

Figure 5:
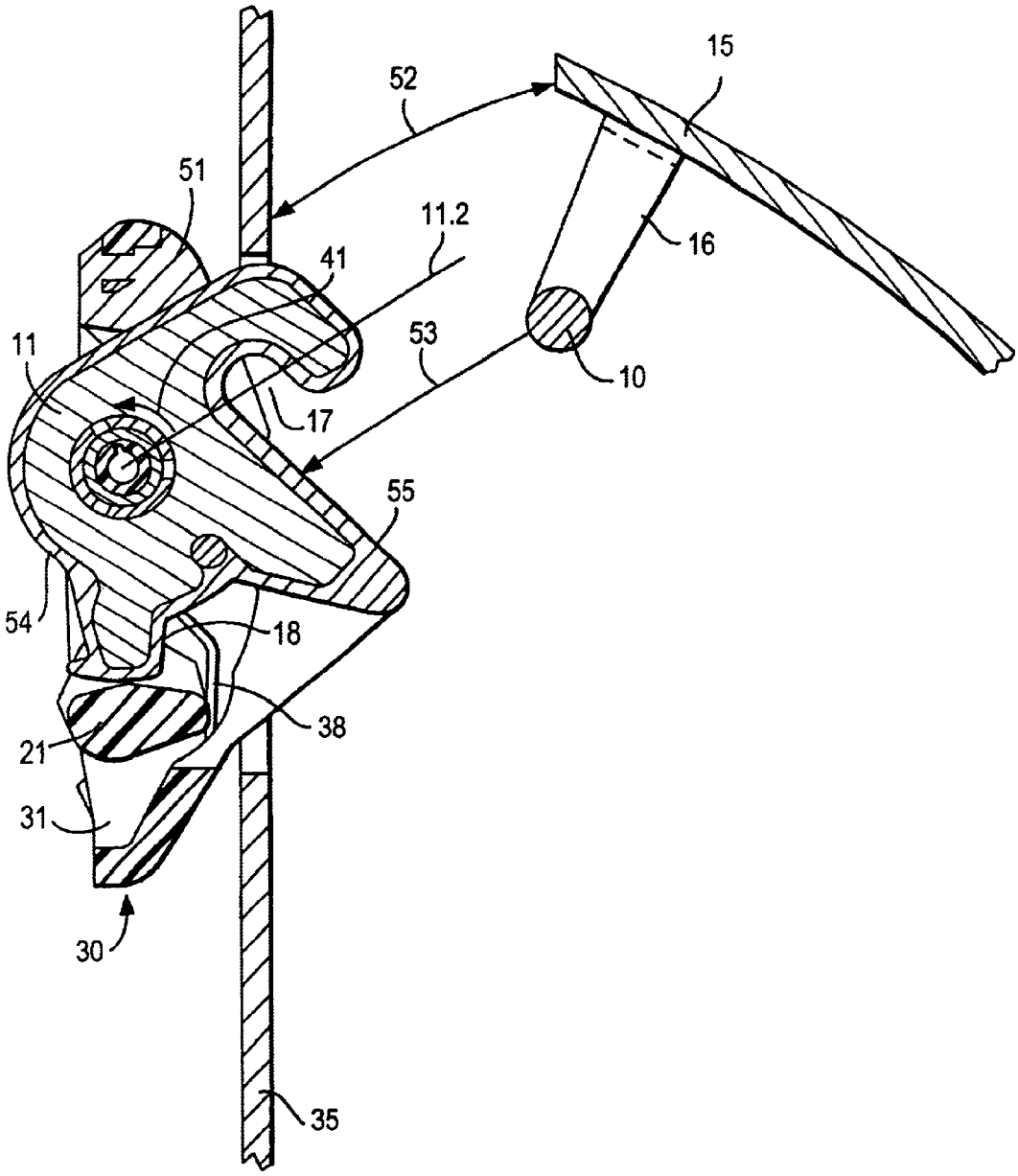
FIG. 5 shows a view of the same area as that of FIG. 4 with the closing piece in its release position.

As shown in FIGS. 4 and 5, each of the rotary latches 11, 12 has an opening 17, which holds the closing piece 10 after the rotary latch 11 has been pivoted into the position indicated by the auxiliary line 11.1, which is to be referred to here as the "closed position". In this state, the pivoting flap 15 is fastened to its housing 35. This locking position 11.1 is secured by a first locking element 31, which grips a radial shoulder 18. The same is also true for the other rotary latch 12, as shown in FIG. 1, in which a second locking element 22 is supported against a similar radial shoulder 19 provided on that latch 12.

The locking elements 21, 22 are seated at the ends of a common shaft 20, which connects the two of them together and with which they form an integral piece of plastic, thus forming a combination with it. This shaft 20 has support pins 23, 24 at its ends, as indicated in broken line in FIG. 1, which fit into corresponding blind holes, which face each other.

The blind holes belong to two end bearings 36, 37, which are designed as integral parts of the carrier 30. The rotational axis 25 of the shaft 20 and of its locking elements 21, 22 is indicated in dash-dot-line in FIG. 1 and is also marked in FIGS. 4 and 5. Both the rotary latches 11, 12 and also the one-piece combination 40 are subject to the action of restoring forces, which in the present case are produced by restoring springs 38, 39 with two sidepieces, which act on both components.

As illustrated in FIG. 4, the restoring spring 38 shown there exerts a force acting in the counterclockwise direction as shown by the force arrow 41; this force tries to move the rotary latch out of the closed position 11.1 of FIG. 4 into the other rotational position, illustrated by the auxiliary line 11.2 in FIG. 5. The rotary latch 11 is prevented from doing this, however, as long as the locking element 21 associated with it is supported against the shoulder 18. The locking element 21 is itself being acted on by the force of the restoring spring 38, this force acting in the clockwise direction shown by the force arrow 42 in FIG. 4.

Figure 2:
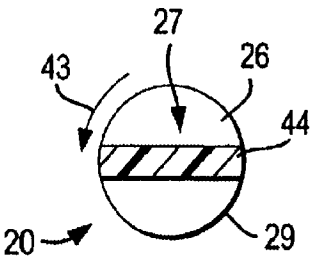
FIGS. 2 and 3 show enlarged cross sections through the profiled shaft in the structural unit of FIG. 1 along lines II—II and III—III, respectively, in that figure.
Figure 3:
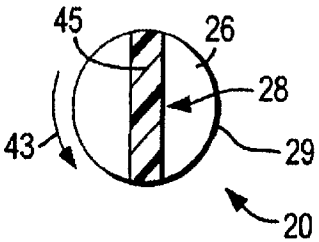

In the previously mentioned combination 40, the shaft 20 has a special profile, which makes it torsionally rigid in the rotational direction 43 according to FIGS. 2 and 3, but flexible in the axial direction 25. This is achieved in that the shaft 20 is produced in such a way that it consists of an alternating sequence of rigid axial sections 26 and flexible axial sections 27, 28 as shown in FIG. 1. The rigid axial sections 26 consist of disks with a circular outline 29, which are positioned in stack-like fashion a certain axial distance apart, the gaps between them being bridged by two diametric webs 44, 45. Successive webs 44, 45 are perpendicular to each other. The webs 44, 45 act as "film hinges" between the successive disks 26. Whereas the one web 44, which extends horizontally, for example, according to FIG. 2, allows bending in the vertical direction, the other, vertical web 45 provides flexibility in the horizontal direction. The extent of this flexibility is determined by the axial dimension of the web between the successive disks 26 and the radial thickness of the web. The torsional rigidity is obtained as a result of the continuity of the web structure and the relatively low height of the webs between adjacent disks 26.

The one-piece combination 40 makes it possible to install the shaft 20 quickly and conveniently. Advantage can be taken of its flexibility for this purpose. For the installation process, the shaft 20 is bent until the terminal bearing pins 23, 24 of the combination unit 40 just fit between the two end bearings 36, 37 of the carrier 30. Then, by inserting the bearing pins 23, 24 into the above-mentioned blind holes, the shaft 20 can be introduced axially into the associated end bearings 36, 37. After the shaft has been fitted into the bearings, a clip 48, which extends over the installed shaft 20 and is attached to the holders 49 on the carrier, limits the flexure of the central part of the shaft 47. As a result, a central support point is created, which prevents the shaft from bending so sharply outward again in this area 47.

A trigger 50, on which manually operated actuating means (not shown in detail) act, is present on the combination 40. Torque is exerted only on the trigger 50; there is no need to exert any torque by way of the locking elements 21, 22. When the trigger 50 is moved out of the supporting position in FIG. 4 and into the release position shown in FIG. 5, in which the radial shoulder 18 of the rotary latch 11 is released, the rotary latch 11 pivots automatically into the previously mentioned other position 11.2 under the action of the restoring force 41. This rotational position 11.2 is determined by bumpers 51, which also damp the noise, and against which the rotary latch 11 is supported. These bumpers 51 are a component of the associated bearing block 31 of the carrier 30. In this rotational position 11.2, the movable part 15, e.g., a flap, can be pivoted in the direction of the double arrow 52 of FIG. 5. With respect to the support of the flap 15, the rotary latch 11 assumes a position in which the associated closing piece 15 can be moved into or out of the latch opening 17. This path of movement 53 is indicated in FIG. 5 in dash-dot line.

The associated locking element 21 rests under the action of the previously mentioned restoring force against the profile of the rotary latch 11. For this reason, the outside surface of the latch, which is made of metal, is provided with a sheath 54, as indicated by the crosshatching in FIG. 5, consisting of an elastomeric material. Preloaded by the restoring spring 38, the locking element 21 is ready to move from the position shown in FIG. 5 into the position under less tension according to FIG. 4. During the previously mentioned pivoting movement in the closing direction, the closing piece 10 strikes a projection 55, which forms one boundary of the latch opening 17, and thus rotates the rotary latch 11 back into the closed position 11.1 against the force of its restoring spring 41. The locking element 21 is able to move automatically behind the latch shoulder 18 again and thus locks the assembly in the closed position 11.1.

While specific embodiments of the invention have been shown and described in detail to illustrate the inventive principles, it will be understood that the invention may be embodied otherwise without departing from such principles.

I claim:

1. A lock, for securing a movable part in position relative to a stationary part, the lock comprising two rotary latches arranged at a certain distance apart, two closing pieces engaging the two rotary latches when the latches are in a closed position, and two locking elements for holding the two rotary latches in the closed position, and a shaft integrally formed with the two locking elements for connecting the locking elements, such that the locking elements are rotatable synchronously with the shaft, wherein the shaft has ends that are rotatably mounted in fixed bearings, wherein the shaft comprises alternating sections of inflexible axial sections and flexible axial sections so that the shaft is flexible in the axial direction, in a bent condition the shaft has a length that is smaller than a distance between the fixed bearings, the shaft being mounted in the bent condition when the shaft ends are at first aligned with the fixed bearings, the shaft then being straightened whereby the shaft ends enter the fixed bearings.

2. The lock according to claim 1, wherein two axial sections are integral parts of a single unit, but of two different materials, wherein one axial section is of a flexible plastic and another axial section is of a rigid plastic.

3. The lock according to claim 1, wherein two axial sections are of the same material, but have different profiles.

4. The lock according to claim 3, wherein the material of the axial sections is plastic.

5. The lock according to claim 3, wherein the inflexible axial sections are comprised of discs which are connected by radial webs, and wherein the webs form the flexible axial sections and are torsionally rigid.

6. The lock according to claim 5, wherein the discs have a circular outline and the webs extend across the diameters of the discs.

7. The lock according to claim 6, wherein successive webs are offset relative to each other in the direction of rotation.

8. The lock according to claim 7, wherein successive webs are perpendicular to each other.

9. The lock according to claim 3, wherein the shaft has a lamella structure.

10. The lock according to claim 1, further comprising a carrier for supporting the two locking elements in combination with the shaft, wherein the carrier together with the two rotary latches and with restoring springs forms a pre-assembled structural unit which is attached to the stationary part or to the moving part.

11. The lock according to claim 10, wherein the shaft has two support pins formed at two ends thereof for supporting the shaft, and wherein the carrier has two blind holes facing each other, wherein the bearing pins can be axially inserted into the blind holes by temporarily bending the shaft.

12. The lock according to claim 11, wherein, after the shaft has been mounted, the shaft is covered in an area of maximum flexure by a clip, wherein the clip is attached to the carrier so as not to interfere with the rotation of the shaft, wherein the clip cancels the flexibility of the shaft in the area of maximum flexure.

* * * * *